United States Patent [19]

Corrigan

[11] 4,176,055

[45] Nov. 27, 1979

[54] ROTARY AIR CLASSIFIER

[75] Inventor: Patrick Corrigan, Retford, England

[73] Assignee: Newell Dunford Engineering Limited, England

[21] Appl. No.: 847,495

[22] Filed: Nov. 1, 1977

[30] Foreign Application Priority Data

Aug. 15, 1977 [GB] United Kingdom ..... 34238/77

[51] Int. Cl.[2] ..... B07B 4/06

[52] U.S. Cl. ..... 209/152; 209/144

[58] Field of Search ..... 209/152, 144, 473, 482

[56] References Cited

U.S. PATENT DOCUMENTS

| | | | |
|---|---|---|---|
| 883,278 | 3/1908 | Belt | 209/152 |
| 993,593 | 5/1911 | Guernsey | 209/473 |
| 1,518,031 | 12/1924 | Waterman | 209/152 |
| 1,666,130 | 4/1928 | Frederick | 209/473 X |
| 2,651,812 | 9/1953 | Black | 209/144 |

FOREIGN PATENT DOCUMENTS

| | | | |
|---|---|---|---|
| 125972 | 11/1901 | Fed. Rep. of Germany | 209/152 |
| 511733 | 1/1955 | Italy | 209/144 |
| 242487 | 11/1925 | United Kingdom | 209/152 |

*Primary Examiner*—Ralph J. Hill

*Attorney, Agent, or Firm*—Craig and Antonelli

[57] ABSTRACT

A rotary air classifier for separating light material from a mixture of heavy and light material, or for separating large particles from small particles in a single material or a mixture of materials, such as in the sorting of municipal garbage, in which a tapered, e.g. frusto-conical, vessel is mounted about an axis, so that the lower surface of the vessel slopes downwardly towards the open lower end. Air is caused to spiral from the open lower end to the open upper end and takes with it the ligher fraction of material to be classified. The heavy articles slide or roll downwardly out of the open lower end.

8 Claims, 5 Drawing Figures

ROTARY AIR CLASSIFIER

The present invention relates to classifiers for separating light materials from a mixture of heavy and light materials or for separating large particles from small particles from a single material or a mixture of materials. The classifier of the present invention is also suitable for separating mixtures of particles of different shapes, such as massive particles from plate-like particles of similar density e.g. tin from ferrous scrap.

It is often advantageous to be able to separate materials in the above manner and a particularly important application is in the separation of paper, plastics material and rags from domestic refuse in a raw or pulverised state, to enable the material to be fed to an incinerator apparatus.

According to the present invention it is proposed to provide a classifier comprising a vessel which is open at both ends, the axis of the vessel, in a direction transverse to the open ends, being inclined to the horizontal, means being provided to feed material to be classified into the upper open end and means being provided to introduce air into the vessel, so as to cause the air to flow spirally within the vessel and axially out of the upper end.

With such an arrangement, the material to be sorted is fed into the upper open end or some convenient point within the vessel, and the lighter or smaller particles are caught up by the spiralling air stream and thrown out at the upper open end. Heavy or large particles remain in the vessel and roll or slide, by one path or another, down the slope and out of the lower end of the vessel. By these means, the separation of light or small particles is achieved from the particles of greater density or of larger size.

Although it is advantageous for the vessel to have an internal surface which is formed by rotating a line about the axis, it is contemplated that the vessel could be made of generally polygonal cross-section, for example, having several i.e. ten or more sides.

In a preferred construction of classifier according to the invention, the vessel is wider at the upper open end than at the lower open end. Thus, the most convenient construction of vessel is for it to be of frusto-conical formation. The angle of the cone, however, should be such that the lower surface of the interior wall of the vessel still slopes downwardly towards the lower open end, to allow the heavier material to roll down within the vessel to the lower end and thus out of the vessel.

The air is advantageously fed into the vessel by means of one or more pipelines extending along the wall of the vessel, substantially parallel to the axis, the or each pipeline being provided with a jet which extends approximately along a tangent of the internal wall of the vessel.

Where more than one pipeline is provided, a manifold may be arranged to introduce air only at certain portions of the circumference of the classifier. If the vessel is wide at the upper end, this in itself would tend to cause the air to flow out of the upper end. Advantageously, however, additional means may be provided to induce a flow of air from the lower to the upper end of the vessel. With such a construction, it is possible to provide further means to cause at least a major proportion of the air leaving the upper open end of the vessel to be recycled to flow back into the lower open end. With such an arrangement, an air filter may be provided for the passage of the remainder of the air which is not recycled. Such an arrangement has the advantage that the amount of air to be moved is greatly reduced, so that the power required to run the classifier is significantly reduced.

Desirably, the vessel is caused to rotate about its axis and the direction of rotation is advantageously the same as the direction of rotation of the spiral air flow. A deflector plate may be fitted behind the line of air jets to prevent the material catching on the tube or tubes holding the jets. In a preferred construction, however, the tubes are arranged, in effect, behind the wall of the vessel and have jets which project the air through openings in the wall.

If desired, the vessel may comprise two substantially coaxial vessels, in which the inner vessel is perforated and these perforations allow through fine, heavy particles, for example finely shredded grass. These particles would then be carried down the slope of the outer vessel and separate discharges at the lower open end.

In another variation, the air jet positions may be arranged in non-regular pattern along the length of the pipelines, in order to achieve variation of the density of flow of the spiralling air stream. It is also contemplated that the inner wall of the vessel may be fitted with lifters, mechanically to raise the material to be separated up the side of the rotating vessel to allow its discharge at a higher level. One or more sets of air jets may be placed within the vessel to induce the spiral flow and the air may be fed either continuously or repulsed at various magnitudes.

A lance may extend into the open lower end of the vessel to project a high velocity stream of air into the vessel to discharge the very light articles such as tin cans which can be thus separated from the remainder of the material. The lance is preferably directed at an angle to the axis of the drum and at an angle to the adjacent radius of the drum.

In order that the invention may more readily be understood, the following description is given, merely by way of example, reference being made to the accompanying drawings, in which.

Figure 1:
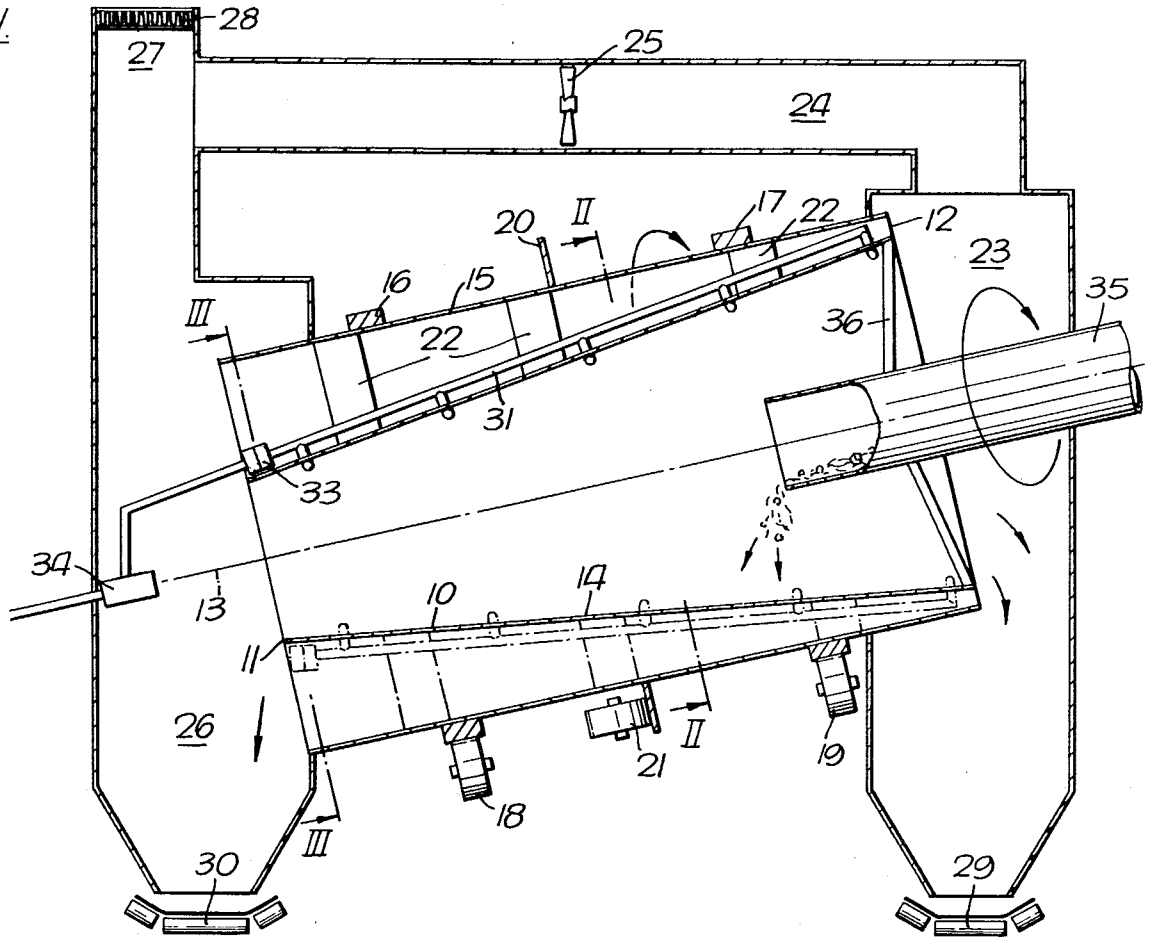
FIG. 1 is a schematic side elevation, in section, of one embodiment of classifier according to the invention.
Figure 2:
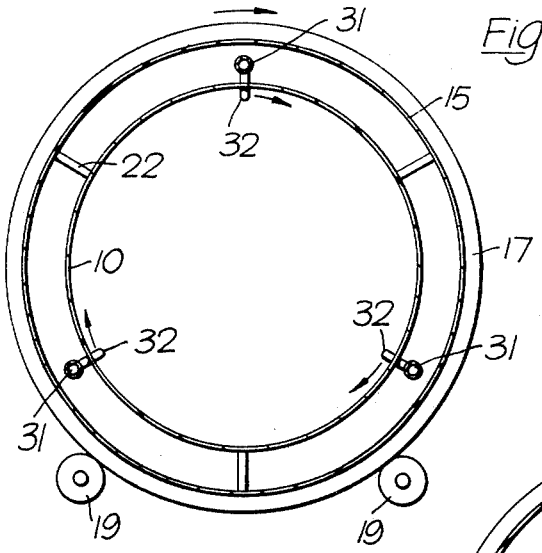
FIG. 2 is a section taken along the line II—II of FIG. 1.
Figure 3:
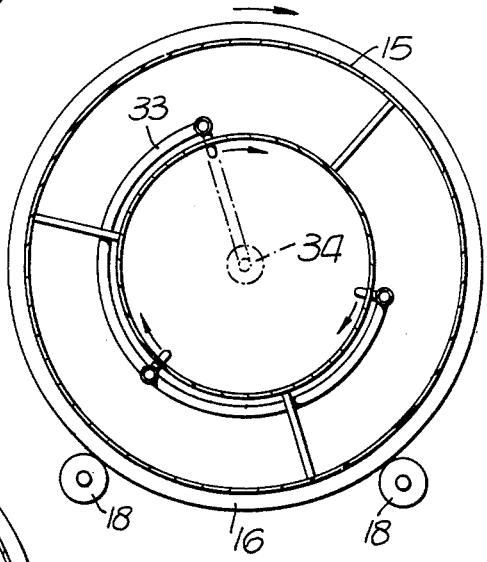
FIG. 3 is a section taken along the line III—III of FIG. 1.

Referring first to FIGS. 1, 2 and 3, the classifier indicated therein comprises a vessel 10 in the form of a frustum of a cone, the vessel being open at its lower end 11 and at its upper end 12. As can be seen, the axis 13 of the vessel 10 is inclined at an angle to the horizontal which is sufficiently large for the lower interior surface 14 of the vessel also to be inclined to the horizontal.

The vessel 10 is mounted within an outer cylindrical casing 15 which itself has the same axis 13 and is provided with running rings 16 and 17 which enable the casing 15 and drum 10 to rotate about the axis 13, the running rings being supported by rollers 18 and 19, a thrust flange 20 extending radially outwardly from the housing 15 and engaging a further thrust roller 21. Structural members 22 support the vessel 10 within the casing 15.

The upper open end 12 is mounted within a first collection chamber 23 which is connected, via a recycle duct 24 having a fan 25 therein, with a second chamber 26 which has the lower end 11 of the vessel 15 opening thereinto. An air discharge vent 27 provided with an air filter indicated schematically at 28 is connected to the duct 24.

The first chamber 23 is tapered at its lower end so that materials discharged therefrom can leave and be collected on a discharge conveyor 29 whilst a similar arrangement is provided in the second chamber 26, material flowing therethrough being collected on discharge conveyor 30.

As indicated more clearly in FIGS. 2 and 3, three air tubes 31 extend parallel to the axis 13 at circumferentially spaced locations. These air tubes are provided along their length with a plurality of spaced apart nozzles 32 which are arranged to project air along the inner wall surface of the vessel 10 as generally tangential flow. A manifold 33, which is fixed in space, is arranged selectively to feed air from an air supply 34 to the pipelines 31 at such times as the latter are aligned with the portion of the manifold which can be seen in FIG. 3.

A rotating inlet conveyor tube 35 extends along the axis of the vessel 10 and into the upper end 12 thereof, this tube being supported by a spider arrangement 36 on the inner wall of the vessel 10.

In operation of the above described classifier, the casing 15 and thus the vessel 10 are caused to rotate in a clockwise direction, as viewed in FIG. 2, and air under pressure is introduced via airline 34 so that air is discharged into the container along the direction illustrated by the arrows in FIG. 2, that is to say again in a generally clockwise direction thus inducing spiral flow from the lower to the upper end of the vessel. This induces, along the axis, a vortex. Material to be classified is fed down along the conveyor 35, which is caused to rotate at the same speed as the vessel by the spider 36 and the material is therefore drawn in by the vortex action. At the same time, the fan 25 is switched on, thus causing a flow from the first chamber 23 to the second chamber 26 and, it will be appreciated, a flow from the lower end 11 to the upper end 12 of the vessel 10.

The air, particularly air induced by the nozzles 32, entrains the lighter and/or smaller particles and projects these out of the upper end 12 so that they fall downwardly in the chamber 23 onto the conveyor 29. The heavier and/or larger particles are not entrained by the air to such an extent, and therefore roll or slide down the interior wall 14 of the vessel and out of the open lower end 11 to fall within the chamber 26 and thence onto the discharge conveyor 30.

Figure 5:
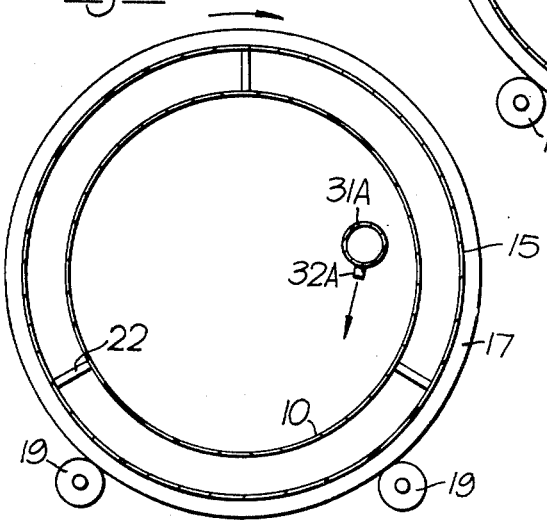
FIG. 5 is a section taken along the line V—V of FIG. 4.
Figure 4:
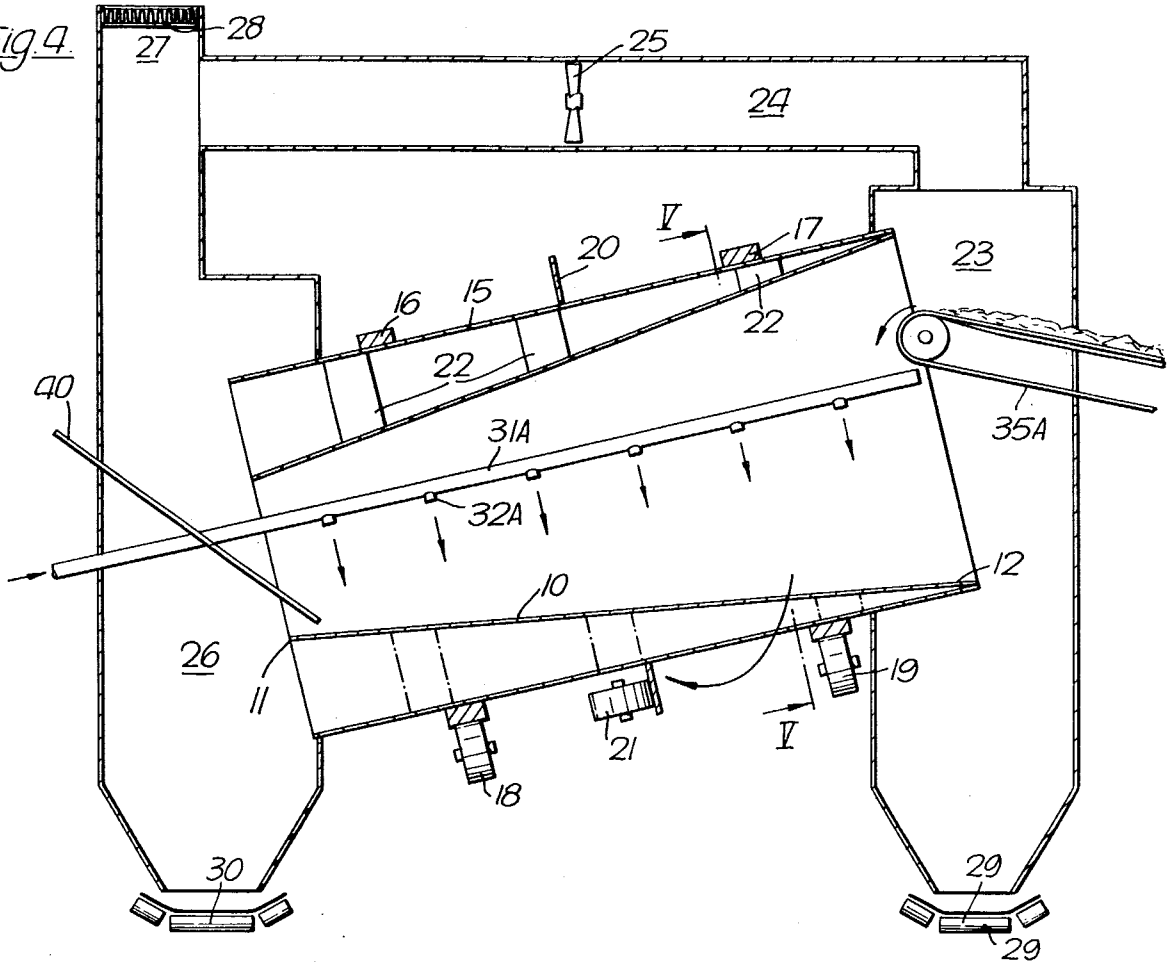
FIG. 4 is a view similar to FIG. 1 of a second embodiment.

The construction illustrated in FIGS. 4 and 5 is generally similar to that illustrated in FIGS. 1, 2 and 3 and like parts have been indicated by like reference numerals. The main change is in the method of introducing the air to cause the spiral flow and the method of introducing the material to be treated. In the construction shown in FIGS. 4 and 5, the air inlet pipeline 31A is arranged within the vessel and spaced from the wall thereof. This is a simpler construction than that illustrated in FIG. 1. Instead of having the inlet conveyor 35 as a rotating tube, a simple belt conveyor 35A is illustrated in FIG. 4. The apparatus, in fact, operates in precisely the same way as the apparatus of the earlier embodiment.

As an additional feature of the invention which may be employed either in a structure as shown in FIG. 1 or the structure of FIG. 4, an air lance 40 is provided which is directed at an angle to the axis of the drum and at angle to the radius of the drum. The lance 40 extends slightly downwardly. The effect of providing this lance, through which a jet of air can be projected at high speed, is to blow light articles, such as cans, out of the upper end of the vessel. Since the tin available in cans is recuperable and of high commercial value, this form of separation is very effective.

I claim:

1. In a classifier comprising a vessel having an axis and opposite open ends, means mounting the vessel for rotation in one direction about the axis with said axis inclined, said open ends being an upper open end and a lower open end, means for feeding material to be classified into the upper open end, and means for introducing into the vessel a flow of air in a direction substantially tangential to the interior wall of the vessel, the improvement comprising:

(a) means for rotating the vessel in the same direction as the direction of said flow of air about said axis, (b) a plurality of individual jet orifices arranged along at least a portion of the length of said vessel for said introduction of the flow of air as a plurality of concentrated jets, and (c) said vessel being frusto-conical in shape with said upper open end being larger than said lower open end and with the lower surface of the interior wall of the vessel sloping downwards towards said lower open end, whereby said flow of air from said jet orifices causes an induced additional flow of air from said lower open end to said upper open end and itself smoothly flows spirally within the conical vessel towards said upper open end during use of said classifier.

2. A classifier as claimed in claim 1, wherein said means for introducing air includes at least one pipe line extending along the wall of the vessel, substantially parallel to said wall, said pipe line being connected to said air jet orifices which extend approximately along a tangent of the vessel.

3. A classifier as claimed in claim 1, and further comprising means to cause at least a major proportion of the air leaving the upper open end of the vessel to be recycled to flow back into the lower open end.

4. A classifier as claimed in claim 3, and further comprising an air filter for the passage of the remainder of the air which is not recycled.

5. A classifier as claimed in claim 1, wherein the means for feeding material to be classified to the upper open end comprise a rotary conveyor adapted to feed the material to be classified adjacent the axis of the conveyor.

6. A classifier as claimed in claim 6, and further comprising a lance extending into the open lower end of the vessel to project a high velocity stream of air as a jet into the vessel.

7. A classifier as claimed in claim 6, wherein the lance is directed at an angle to the axis of the vessel and at an angle to the adjacent radius of the vessel.

8. A classifier as claimed in claim 1, wherein the means to introduce air include a manifold arrangement which introduces air from said jet orifices only at certain portions of the circumference of the vessel.

* * * * *